US012065834B2

(12) United States Patent
Hanje

(10) Patent No.: US 12,065,834 B2
(45) Date of Patent: Aug. 20, 2024

(54) MULTI-AXIAL REBAR CONNECTOR FOR FOLDABLE FRP REINFORCEMENT SYSTEM

(71) Applicant: TUF N LITE LLC, Liberty Township, OH (US)

(72) Inventor: Josh Hanje, Noblesville, IN (US)

(73) Assignee: TUF-N-LITE LLC, Liberty Township, OH (US)

( * ) Notice: Subject to any disclaimer, the term of this patent is extended or adjusted under 35 U.S.C. 154(b) by 0 days.

(21) Appl. No.: 17/724,240

(22) Filed: Apr. 19, 2022

(65) Prior Publication Data

US 2022/0333382 A1 Oct. 20, 2022

Related U.S. Application Data

(60) Provisional application No. 63/176,946, filed on Apr. 20, 2021.

(51) Int. Cl.

| | |
|---|---|
| ***E04C 5/16*** | (2006.01) |
| ***E04C 5/07*** | (2006.01) |
| ***E04C 5/20*** | (2006.01) |

(52) U.S. Cl.

CPC ..... *E04C 5/167* (2013.01); *E04C 5/073* (2013.01); *E04C 5/20* (2013.01)

(58) Field of Classification Search

CPC ..... E04C 5/162; E04C 5/167; E04C 5/166; E04C 5/0609; E04C 5/073; E04C 5/20

See application file for complete search history.

(56) References Cited

U.S. PATENT DOCUMENTS

| | | | | |
|---|---|---|---|---|
| 3,840,054 | A * | 10/1974 | Tolliver | E04C 5/0627 138/175 |
| 4,280,310 | A * | 7/1981 | Tolliver | E04C 5/0609 52/646 |
| 6,766,623 | B1 | 7/2004 | Kalnay | |
| 8,387,239 | B2 | 3/2013 | Wang | |
| 10,280,621 | B2 | 5/2019 | Munsell | |
| 2010/0304117 | A1* | 12/2010 | Scott | E04C 5/04 428/223 |
| 2020/0354271 | A1* | 11/2020 | Taha | E04C 5/07 |

FOREIGN PATENT DOCUMENTS

| | | | |
|---|---|---|---|
| CN | 100535368 | C | 9/2009 |
| CN | 205046858 | U | 2/2016 |
| IT | 0080236 | A2 * | 11/1982 |
| JP | 6713420 | B2 | 6/2020 |
| KR | 102035959 | B1 | 10/2019 |

* cited by examiner

*Primary Examiner* — Adriana Figueroa

(74) *Attorney, Agent, or Firm* — Overhauser Law Offices, LLC

(57) ABSTRACT

Connector for connecting rebar intersections of a foldable FRP rebar cage includes two channels for receiving the intersecting FRP rebar. One channel has a spherical member and the other has arms shaped to hold the spherical member, to allow the connected rebar to rotate in the X, Y and Z axes.

6 Claims, 5 Drawing Sheets

MULTI-AXIAL REBAR CONNECTOR FOR FOLDABLE FRP REINFORCEMENT SYSTEM

CROSS REFERENCE TO RELATED APPLICATIONS

This application claims the benefit of US Provisional Application Nos. 63/176,946 filed 20 Apr. 2021.

FIELD OF THE INVENTION

The present invention relates to ready-to-use concrete reinforcement systems such as rebar cages and their transport, and to devices and methods for forming collapsible rebar cages.

BACKGROUND

It is known to reinforce concrete walls, including corners of walls, with rebar. Also known is rebar not made of steel, but of fiber reinforced resin (FRP). Fiber reinforced plastic ("FRP")-concrete composite structural members are disclosed for example in U.S. Pat. No. 5,599,599.

Concrete has excellent compressive strength however poor tensile strength. Concrete members must be fortified with a reinforcement system. Assembling a reinforcement system (e.g. "rebar cages") is a time consuming process that often requires several personnel. It is also known that pre-assembling reinforcement systems and shipping them to project sites can be costly due to the amount of open spaces within reinforcement systems (un-usable space to transporters).

Rebar cages are typically formed of intersecting pieces of rebar members. Their perimeter defines a substantial interior space. This limits the number of rebar cages that may be transported at once.

Rebar cages have generally not been made to be collapsible or foldable for transportation. This is because the intersections of rebar in a rebar cage must be strong enough to maintain their structural integrity if the rebar is moved between folded and unfolded shapes, i.e., to not fatigue or break. Rebar cages have intersections that have typically been held together by twist ties, or wires such as those described in U.S. Pat. No. 10,280,621. While such ties are sufficient to hold intersections together as they are originally formed, the ties can either break if the rebar cages are folded due to the weight of steel rebar, or else the ties can limit the movement of the rebar at intersections to prevent the cages from being fully collapsed or folded.

SUMMARY OF THE INVENTION

Disclosed are pre-assembled reinforcement systems, or rebar cages, and a method for transporting them, such that the cages may be collapsed or folded for transportation, and then unfolded to the original shape needed to be placed in a concrete form, such as Sonotube. The system may include connectors for flexibly and/or pivotally connecting intersecting rebar members that has sufficient strength to allow a rebar cage to be lifted and moved in either its folded or unfolded state while maintaining the integrity of the intersecting connectors. The rebar with which the system is used may be fiber reinforced polymer (FRP), including glass fiber reinforced polymer (GFRP) rebar. Connectors may be used that are sized to hold rebars of different diameters where they intersect.

DETAILED DESCRIPTION

Figure 1:
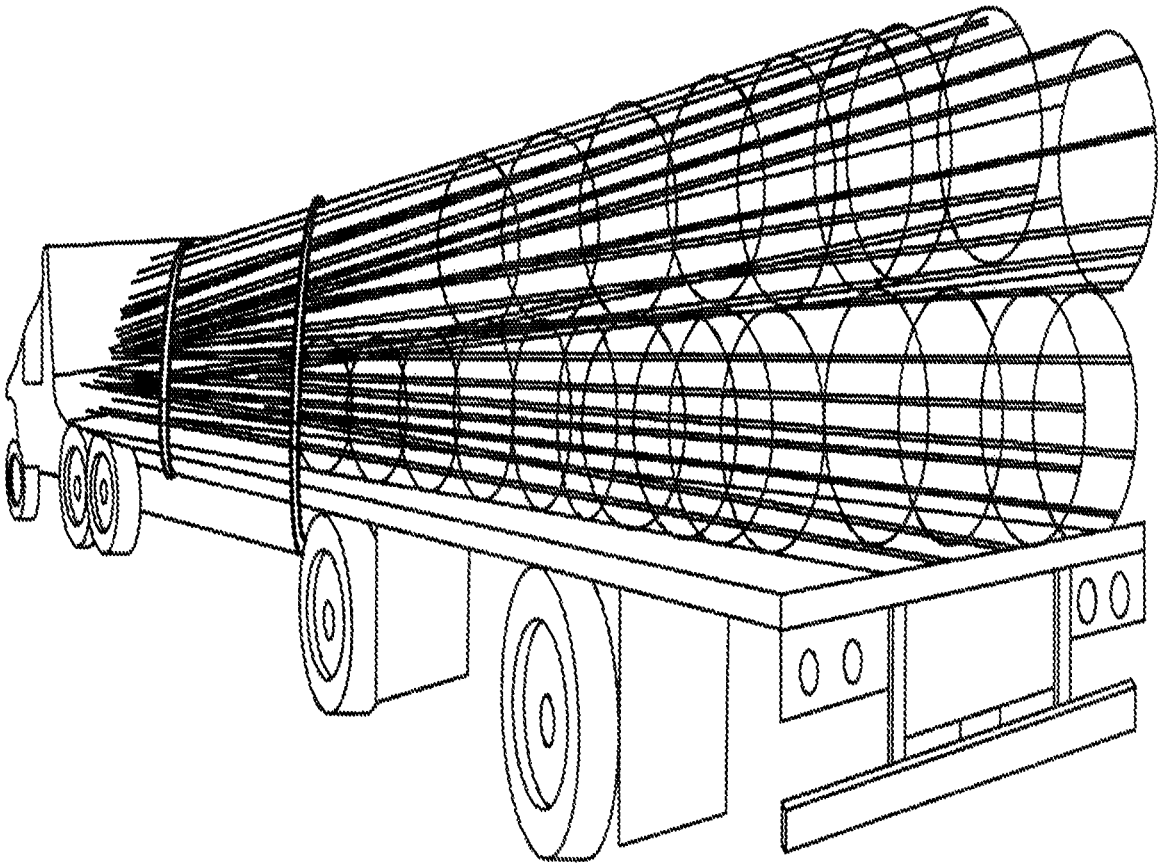
FIG. 1 shows the inefficient dead space on a trailer transporting prior art steel concrete reinforcement systems.

In one embodiment, the invention comprises a rebar cage made of GFRP rebar. The intersections of the rebar cage may be held together either by conventional twist ties, or by pivotable connectors as described further below. GFRP rebar is sufficiently light to allow conventional rebar ties to be employed. In this embodiment, a rebar cage is manufactured in a desired shape, such as a cylinder as shown in FIG. 1. In this embodiment, there are four vertical members 1 and four circular stirrup members 2. A rebar connector is at each intersection of rebar and is of sufficient strength to maintain the shape of the rebar cage. In FIG. 1, the first set of two opposing vertical rebar members are held to stirrups by clips 3 as described further below, and the second set of two opposing vertical rebar members are held to stirrups by conventional wire ties. In addition, in this embodiment, the rebar is GFRP rebar, making the entire rebar case sufficiently lightweight for a person to lift and fold. Because GFRP rebar is lighter than steel rebar, the connectors holding the intersections together will not fatigue or break due to the folding as described below.

The clip connectors 3 (as opposed to the tie-wire connectors) may be hingedly or pivotally connected to each other and sized to receive rebar. The clip connectors may be joined by a hinge, which allows them to rotate in a single plane, or they may be joined by a spherical member. The clips may be made of polyethylene which is sufficiently flexible for the channel sides 5 of each clip to be pushed against rebar until the rebar enters the cylindrical channel 6 between the sides. Connectors 3 generally allow intersecting rebar to be held together at the intersection faster than the time required to use a twist tie. In addition, for rebar that is lightweight, such a GFRP, the clips may be formed of lightweight polyethylene. The clips may have different sizes to accommodate instances in which the widths of the rebar that intersect have different widths.

Figure 3:
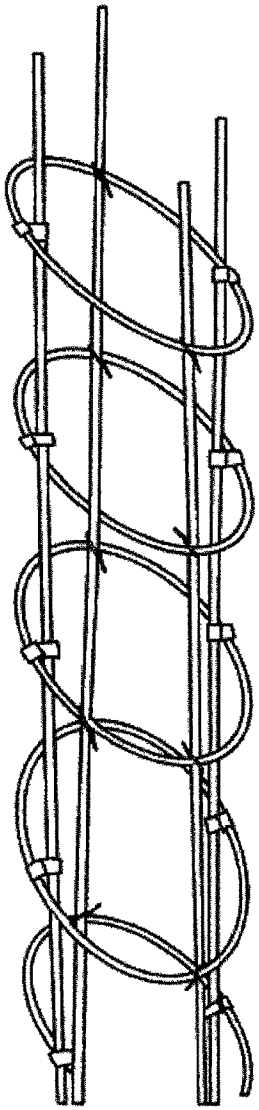

Once the rebar intersections have been provided with connectors (either clips or conventional twist-ties), the rebar intersections may be simultaneously pivoted to fold or collapse the rebar cage. FIG. 3 shows a partially folded rebar cage, and FIG. 4 shows a fully folded rebar cage.

The rebar cage shown in these figures is comprised of GFRP rebar, which is sufficiently light to allow the rebar intersections to be held by the connectors so the connectors do not break or become detached from the rebar.

Figure 4:
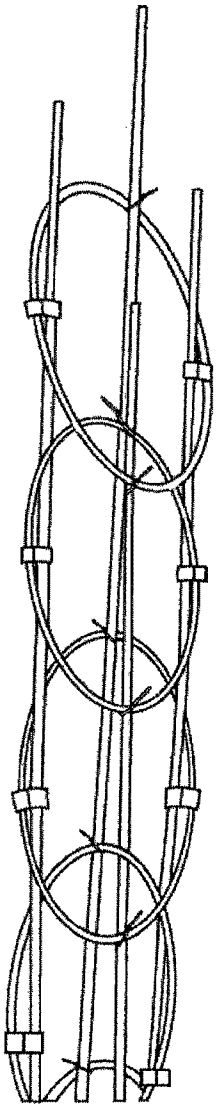
FIGS. 2, 3 and 4 show a columnar rebar cage in an unfolded, partially folded, and fully folded orientation, respectively.
Figure 2:
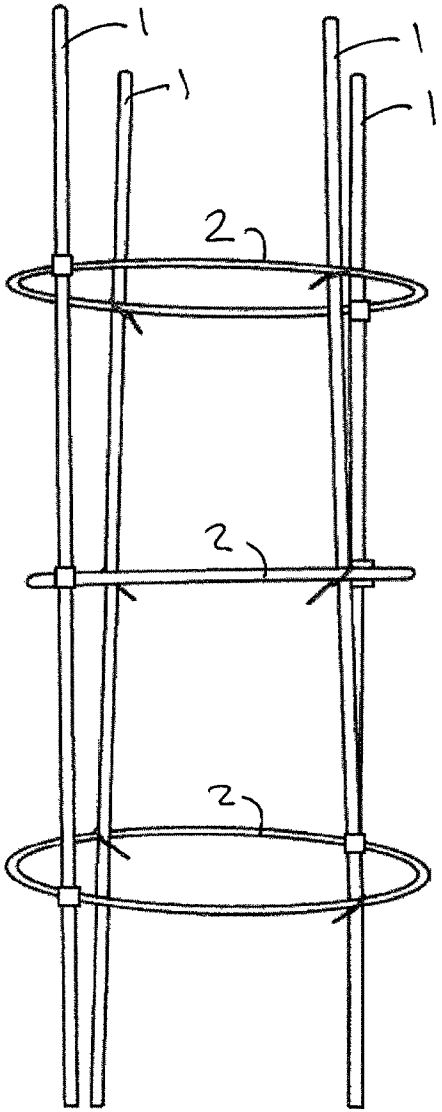

It will be appreciated that in FIGS. 2-4, the only two opposing side vertical rebar pieces attach to connectors having connectors, while the front and rear vertical rebar members are connected using conventional twist-ties. This is because the design of the above hinged-clip connectors allow the clips to pivot around only one axis. Alternatively, a connector design that allows pivoting of clips in all orientations is shown in FIGS. 7-11.

Figure 6:
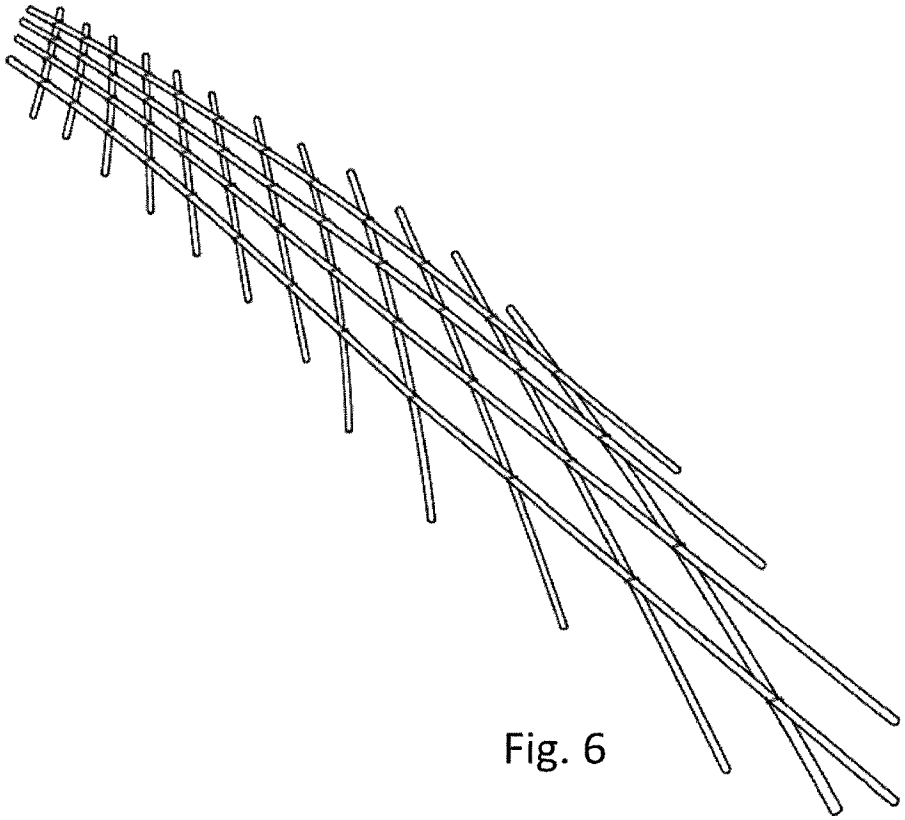
FIGS. 5 and 6 show an unfolded rebar mesh and a folded rebar mesh, respectively.
Figure 5:
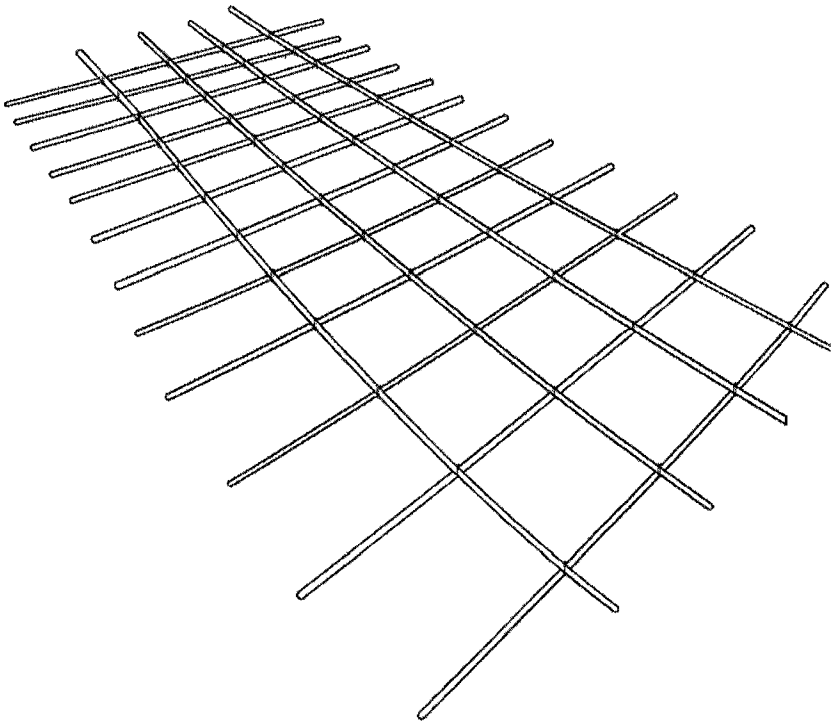

The present invention includes use with mesh rebar as shown in FIGS. 5 and 6. Mesh rebar comprises straight rebar members oriented in a perpendicular orientation as shown in FIG. 5. The rebar connectors allow the mesh to be folded into a compact configuration as shown in FIG. 6.

By providing collapsible and re-formable rebar structures, the structures may be formed away from a construction site, collapsed or folded, transported to the construction site, and then unfolded or re-formed at the construction site. This allows much more efficient operations.

Figure 7:
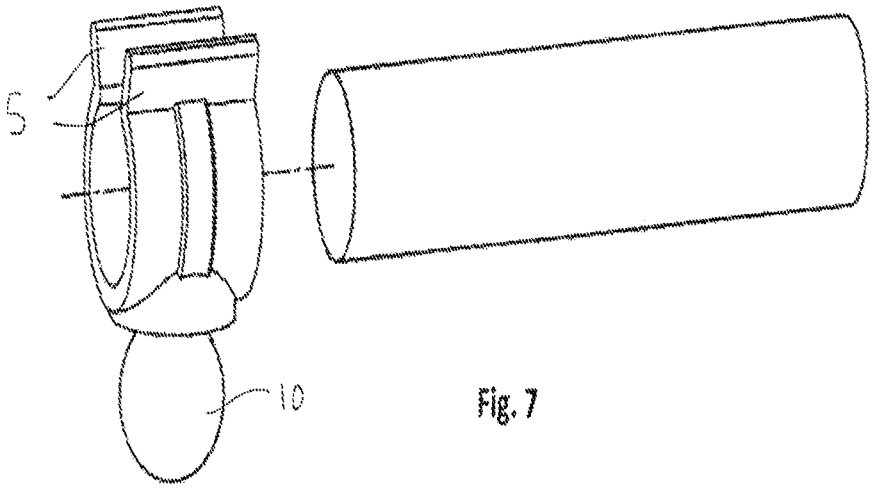
FIG. 7 shows an upper portion of a clip connector having a sphere.
Figure 8:
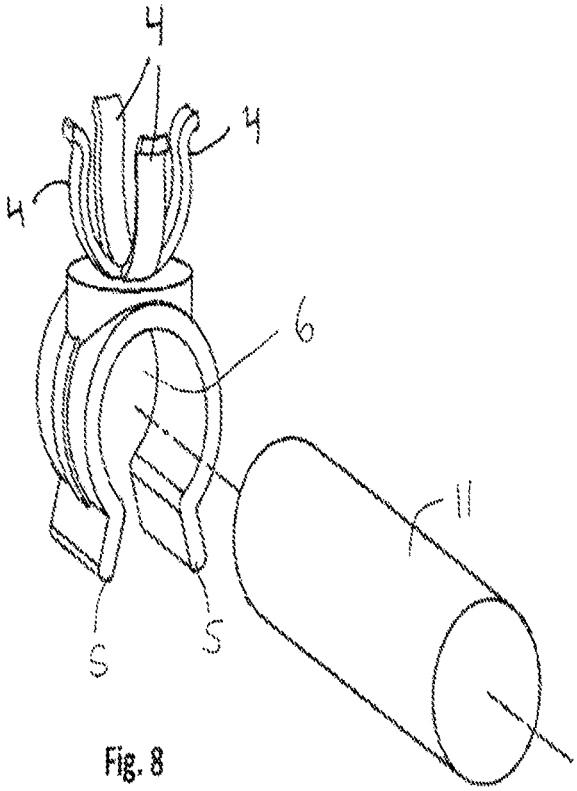
FIG. 8 shows a lower portion of a clip connector having arms that received the sphere of the upper portion shown in FIG. 7.
Figure 9:
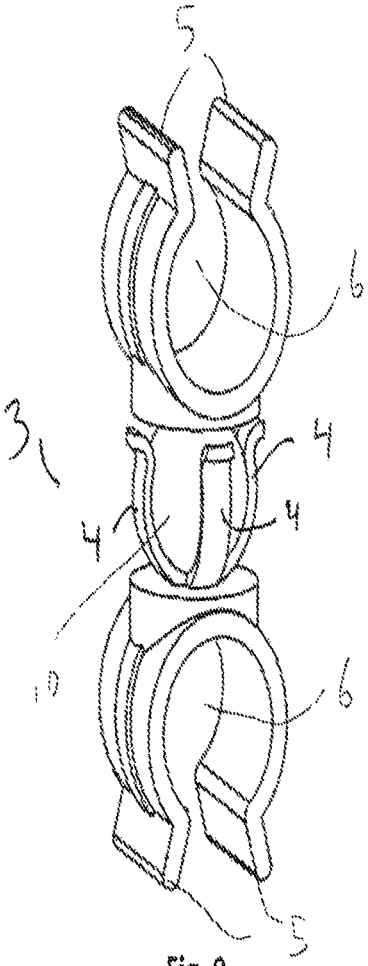
FIG. 9 shows a clip connector with the upper and lower portions engaged by the sphere/arms combination.
Figure 10:
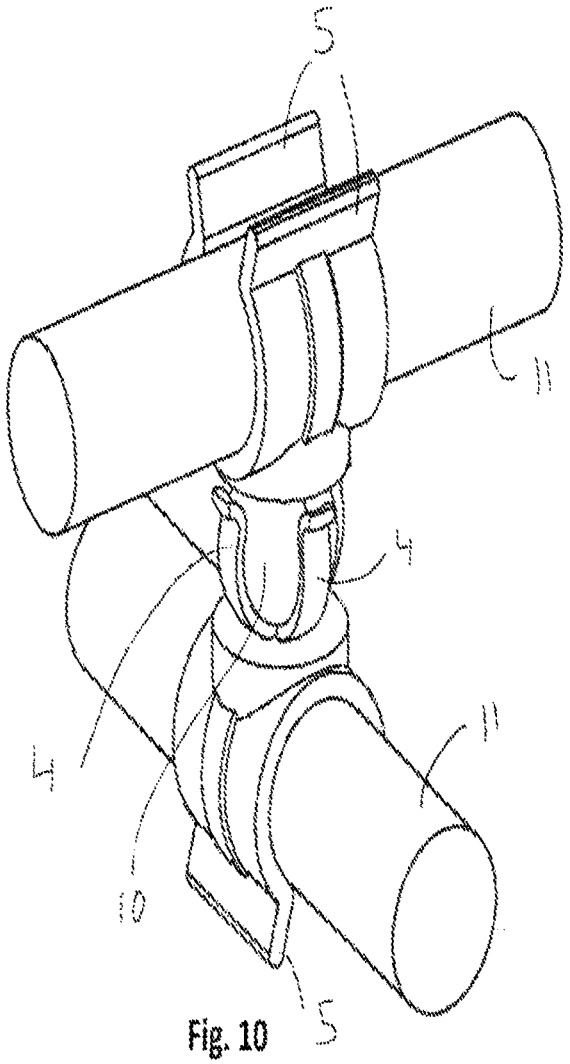
FIGS. 10 and 11 show rebar held by the clip connector and how the rebar may be pivoted about multiple axes due to the spherical—arm construction.
Figure 11:
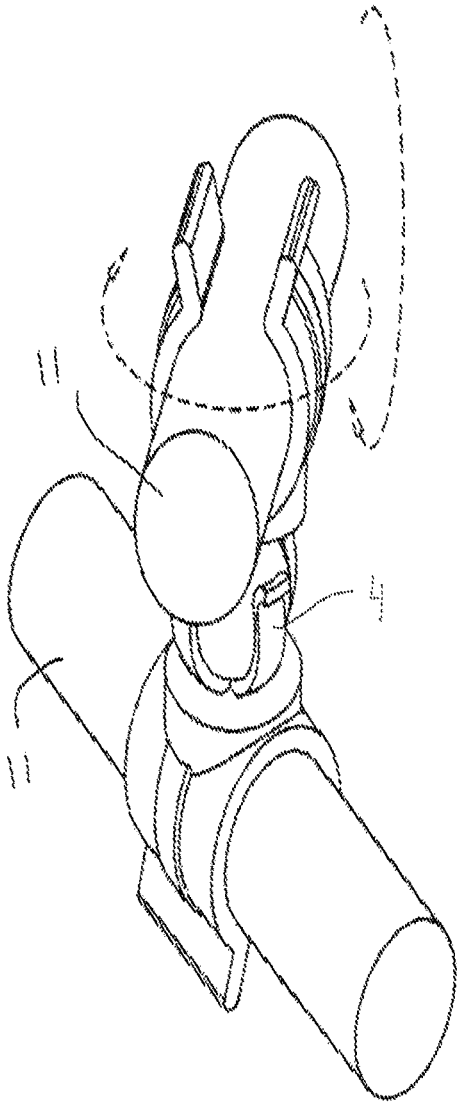

FIGS. 7 and 8 respectively show the upper and lower portions of a connector. Upper portion includes a spherical member 10, and the lower portion that includes multiple arms 4, such as four arms as shown. The arms 4 of the lower portion are sufficiently flexible to be pressed into the spherical member 10 of the upper portion. This allows the upper portion to fully rotate in the X and Y axes with respect to the lower portion, and, to also pivot in the Z axis to the extent the arms of the lower portion do not interfere with the upper portion. This advantageously permits the connector to be used to connect all rebar intersections while allowing sufficient flexibility to allow rebar cages to be folded and unfolded. Each of the upper and lower portions has sides forming a substantially cylindrical channel 6 that my receive rebar. The channel sides 5 are flexible enough to allow them to be pressed over rebar 11 to secure it to the connector. The cylindrical channels of each of the upper and lower portions may be of differing diameters. This makes them suitable of use when the two rebars of different widths form an intersection.

Those of skill in the art will understand that various details of the invention may be changed without departing from the spirit and scope of the invention. Furthermore, the foregoing description is for illustration only, and not for the purpose of limitation, the invention being defined by the claims.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A connector for connecting intersections of a rebar cage comprising:

A first portion comprising:

a spherical member, and sides forming a substantially cylindrical rebar receiving channel;

a second portion comprising:

a plurality of arms shaped to hold the spherical member and having sufficient flexibility to be pressed into the spherical member of the first portion to hold it, sides forming a substantially cylindrical rebar receiving channel;

such that the first portion is rotatable in the X and Y axes with respect to the second portion, and pivotable in the Z axis when the spherical member is held within the plurality of arms of the second portion.

2. The connector for connecting intersections of a rebar cage of claim 1 wherein the connector comprises polyethylene.

3. The connector for connecting intersections of a rebar cage of claim 1 wherein the distance between the sides of the rebar receiving channel of the first portion is different than the distance between the sides of the rebar receiving channel of the second portion.

4. A method for folding and unfolding a rebar cage, comprising:

providing a rebar cage having vertical rebar members and stirrup rebar members, and arranged so that each stirrup member forms a plurality of intersections with a plurality of vertical rebar members, connecting together each intersecting vertical rebar member and stirrup member using a connector of claim 1 such that the rebar cage is in an unfolded position;

folding the rebar cage to a collapsed position;

unfolding the rebar cage to its original unfolded position.

5. The method for folding and unfolding a rebar cage of claim 4 wherein the vertical rebar members and the stirrup rebar members are comprised of steel.

6. The method for folding and unfolding a rebar cage of claim 4 wherein the vertical rebar members and the stirrup rebar members are comprised of GFRP rebar.

* * * * *